US009784103B2

(12) United States Patent
Gross et al.

(10) Patent No.: US 9,784,103 B2
(45) Date of Patent: Oct. 10, 2017

(54) MINING SHOVEL WITH BUSHINGS AT PIN LOCATIONS

(71) Applicant: Harnischfeger Technologies, Inc., Wilmington (DE)

(72) Inventors: Matthew L. Gross, West Allis, WI (US); Richard Nicoson, Hartford, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 89 days.

(21) Appl. No.: 14/693,498

(22) Filed: Apr. 22, 2015

(65) Prior Publication Data

US 2015/0308071 A1 Oct. 29, 2015

Related U.S. Application Data

(60) Provisional application No. 61/983,735, filed on Apr. 24, 2014.

(51) Int. Cl.

| | |
|---|---|
| ***E21C 27/30*** | (2006.01) |
| ***E02F 3/30*** | (2006.01) |
| ***E02F 3/407*** | (2006.01) |
| ***E02F 9/00*** | (2006.01) |

(52) U.S. Cl.

CPC ..... *E21C 27/30* (2013.01); *E02F 3/308* (2013.01); *E02F 3/4075* (2013.01); *E02F 9/006* (2013.01)

(58) Field of Classification Search

CPC ..... E02F 9/006; F16C 11/04; F16C 11/045; Y10T 403/32868; Y10T 403/32877; Y10T 403/32893

See application file for complete search history.

(56) References Cited

U.S. PATENT DOCUMENTS

| | | | | |
|---|---|---|---|---|
| 3,107,951 A | | 10/1963 | Palm | |
| 3,368,852 A | | 2/1968 | Herbenar et al. | |
| 3,392,971 A | | 7/1968 | Herbenar et al. | |
| 3,554,588 A | | 1/1971 | Reinsma et al. | |
| 3,948,574 A | | 4/1976 | Baylor | |
| 4,022,536 A | * | 5/1977 | Piepho | E02F 9/006 403/154 |

(Continued)

FOREIGN PATENT DOCUMENTS

| | | | |
|---|---|---|---|
| CN | 1820123 | 8/2006 | |
| EP | 1353076 | 10/2003 | |
| JP | WO 0188395 A1 * | 11/2001 | E02F 9/006 |

OTHER PUBLICATIONS

Skelton, T., "Urethane bushings," brochure, Dec. 3, 2008, http://www.timskelton.com/lightning/race_prep/suspension/urethane_bushings.htm.

(Continued)

*Primary Examiner* — Jonathan Masinick
(74) *Attorney, Agent, or Firm* — Michael Best & Friedrich LLP

(57) ABSTRACT

A cartridge includes a body, an aperture extending through the body sized to receive a pivot pin, and a spherical bushing disposed within the body. The cartridge also includes a first internal seal disposed axially on one side of the bushing and a second internal seal disposed axially on an opposite side of the bushing. The cartridge also includes an end cap disposed at least partially within the aperture that abuts the bushing and prevents the bushing from moving axially in a first direction within the aperture.

18 Claims, 6 Drawing Sheets

(56) References Cited

U.S. PATENT DOCUMENTS 4,199,199 A 4/1980 Granda
4,241,581 A 12/1980 Chace
4,251,182 A 2/1981 Schroeder
4,311,346 A 1/1982 Danner
5,775,104 A 7/1998 Gardner
5,816,872 A 10/1998 Saito
5,964,325 A 10/1999 Davison et al.
6,068,405 A * 5/2000 Harris ..... F16C 23/045 384/208
6,135,724 A 10/2000 Yoder et al.
6,382,742 B1 5/2002 Hasselbusch et al.
6,962,458 B2 * 11/2005 Takayama ..... E02F 9/006 403/150
7,367,739 B2 * 5/2008 Brock ..... F16J 15/3236 403/288
7,766,433 B2 8/2010 Mulligan et al.
7,845,740 B2 12/2010 Dahlheimer
8,113,597 B2 2/2012 Grenzi
8,821,022 B2 * 9/2014 Akita ..... B22F 3/1146 384/279
2003/0102635 A1 * 6/2003 Akita ..... E02F 9/006 277/549
2006/0093246 A1 * 5/2006 Akita ..... E02F 9/006 384/279
2007/0045069 A1 3/2007 Schedgick et al.
2008/0141513 A1 * 6/2008 Livesay ..... B21K 25/00 29/244
2008/0265667 A1 * 10/2008 Livesay ..... B62D 55/21 305/202
2009/0110472 A1 * 4/2009 Liang ..... E02F 3/3408 403/151
2009/0110530 A1 * 4/2009 Harshberger ..... E02F 3/3411 414/686
2009/0243384 A1 * 10/2009 Diekevers ..... B62D 55/0887 305/202
2010/0148575 A1 * 6/2010 Johannsen ..... B62D 55/21 305/201
2012/0051834 A1 3/2012 McBride et al.
2012/0260538 A1 * 10/2012 Schob ..... E02F 3/4075 37/445
2012/0267947 A1 10/2012 Johannsen et al.
2013/0192101 A1 * 8/2013 Gilmore ..... E02F 9/006 37/445

OTHER PUBLICATIONS

First Office Action from the State Intellectual Property Office of the People's Republic of China for Application No. 201280025408.3 dated Mar. 23, 2015 (19 pages).

* cited by examiner

MINING SHOVEL WITH BUSHINGS AT PIN LOCATIONS

CROSS-REFERENCE TO RELATED APPLICATIONS

This application claims priority to U.S. Provisional Application No. 61/983,735, filed Apr. 24, 2014, the entire contents of which is incorporated herein by reference.

BACKGROUND OF THE INVENTION

The present invention relates to the field of mining machines. Specifically, the present invention relates to the use of bushings at pin locations within a mining machine.

Industrial mining machines, such as electric rope or power shovels, draglines, etc., are used to execute digging operations to remove material from a bank of a mine. On a conventional rope shovel, a dipper is attached to a handle, and the dipper is supported by a cable, or rope, that passes over a boom sheave. The rope is secured to a bail that is pivotably coupled to the dipper. The handle is moved along a saddle block to maneuver a position of the dipper. During a hoist phase, the rope is reeled in by a winch in a base of the machine, lifting the dipper upward through the bank and liberating the material to be dug. To release the material disposed within the dipper, a dipper door is pivotally coupled to the dipper. When not latched to the dipper, the dipper door pivots away from a bottom of the dipper, thereby freeing the material out through a bottom of the dipper.

SUMMARY

In accordance with one construction, a cartridge for use at a pivot pin location on a mining machine includes a body, an aperture extending through the body sized to receive a pivot pin, and a spherical bushing disposed within the body. The cartridge also includes a first internal seal disposed axially on one side of the bushing and a second internal seal disposed axially on an opposite side of the bushing. The cartridge also includes an end cap disposed at least partially within the aperture that abuts the bushing and prevents the bushing from moving axially in a first direction within the aperture.

In accordance with another construction, a mining machine includes a first machine component, a second machine component, and a pivot pin coupled to both the first machine component and the second machine component. The pivot pin pivotally couples the first machine component to the second machine component. The pivot pin includes a first end and a second end spaced axially from the first end. The mining machine also includes a bushing assembly that supports the pivot pin and is coupled to the first machine component. The bushing assembly includes a cartridge having a body and a bushing disposed inside the body. The pivot pin extends through the body. The bushing assembly also includes a plurality of guide components that are coupled to and extend from the first end of the pivot pin, as well as an end plate coupled to the first end of the pivot pin, the end plate including a groove that receives portions of the guide components.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
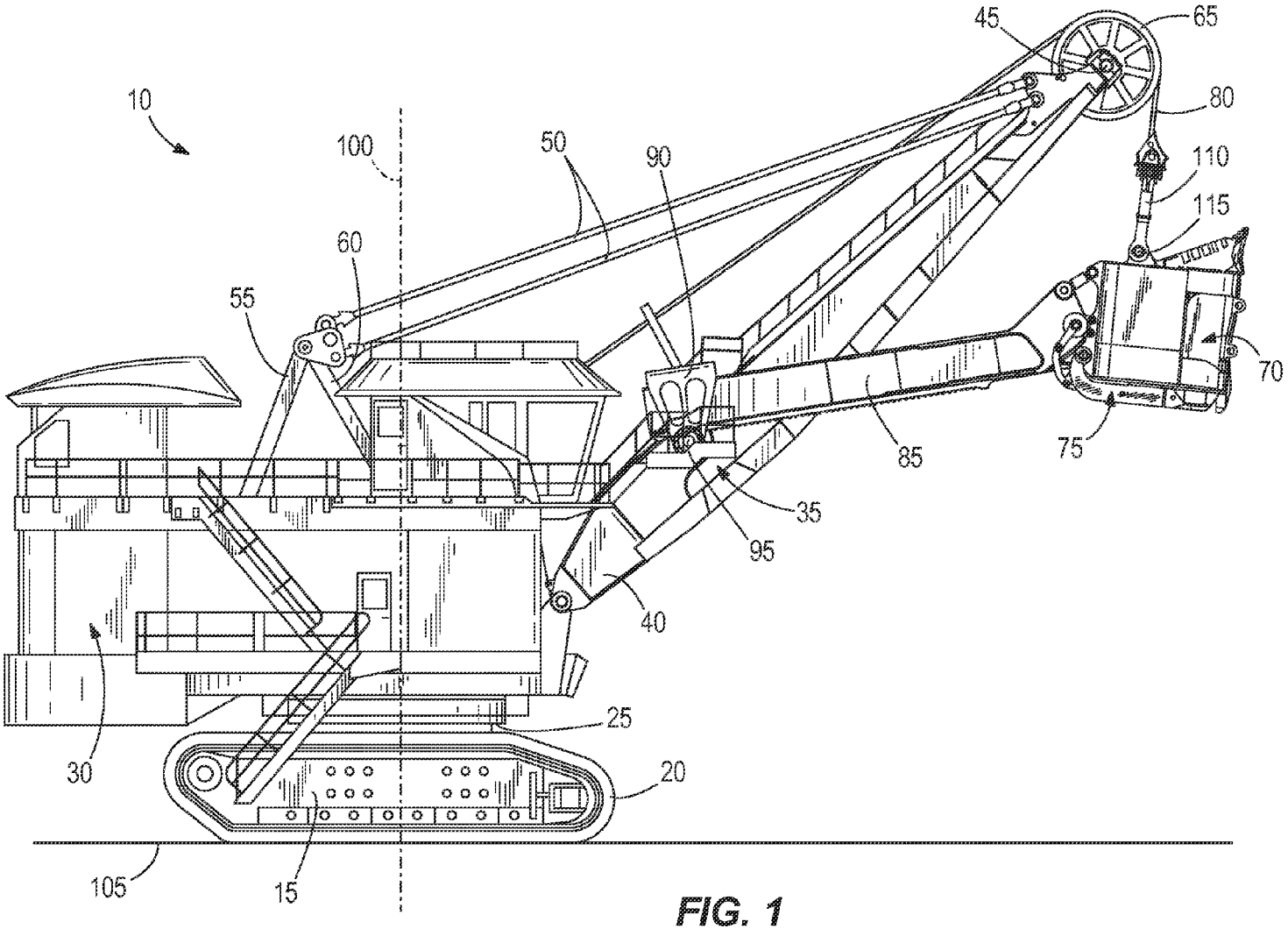
FIG. 1 is a side view of a mining shovel, including a bail and dipper.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave 65 rotatably mounted on the upper end 45 of the boom 35, a dipper 70, a dipper door 75 pivotally coupled to the dipper 70, a hoist rope 80, a winch drum (not shown), a dipper handle 85, a saddle block 90, a shipper shaft 95, and a transmission unit (also called a crowd drive, not shown). The rotational structure 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The dipper 70 is suspended from the boom 35 by the hoist rope 80. The hoist rope 80 is wrapped over the sheave 65 and is coupled to a bail 110. The bail 110 is coupled to the dipper 70 with two bail pins 115 (one shown in FIG. 1). The hoist rope 80 is anchored to the winch drum (not shown) of the revolving frame 30. The winch drum is driven by at least one electric motor (not shown) that incorporates a transmission unit (not shown). As the winch drum rotates, the hoist rope 80 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
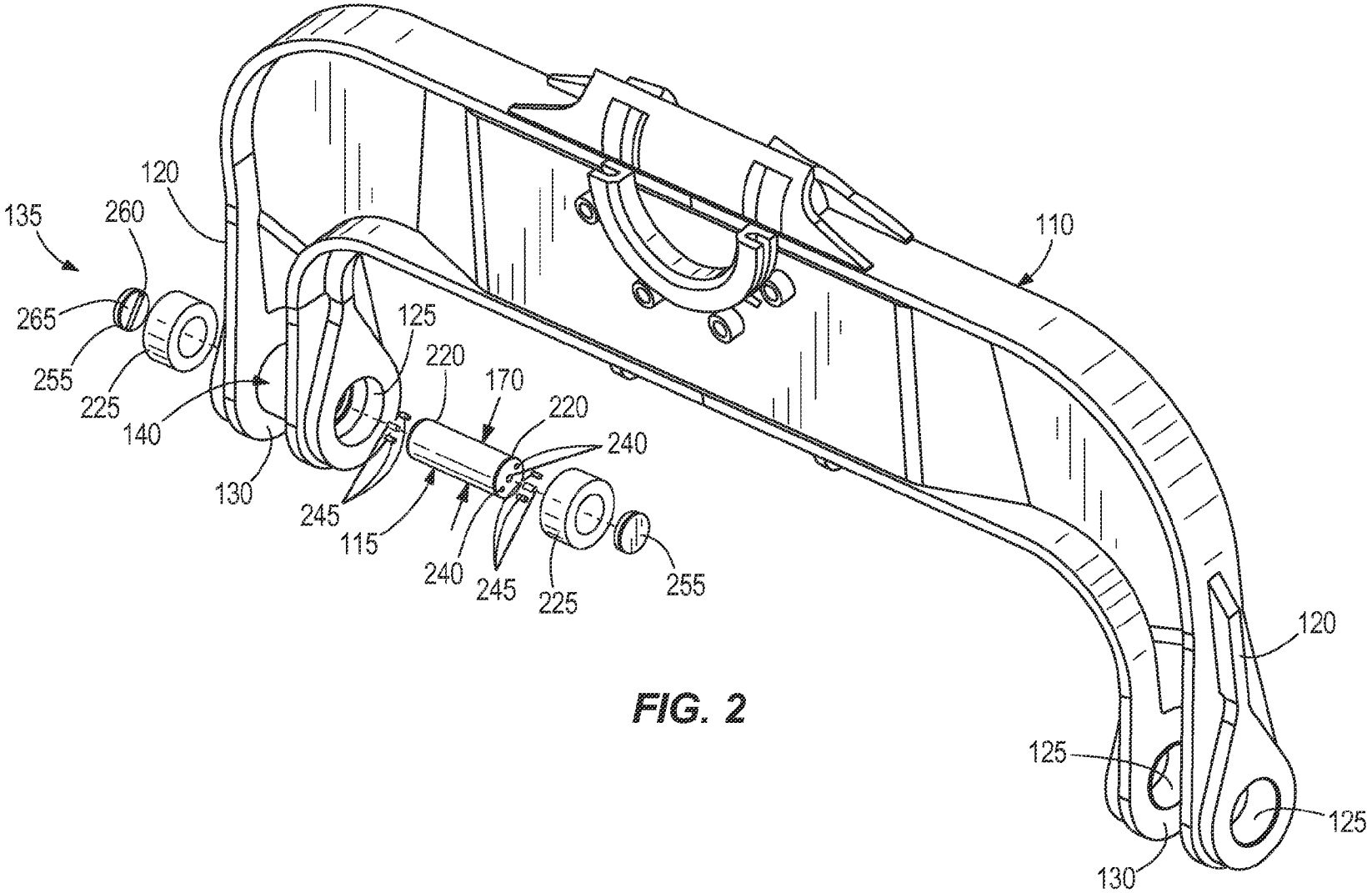
FIG. 2 is a perspective view of the bail, along with an exploded view of a bushing assembly according to one construction for use with the bail.
Figure 3:
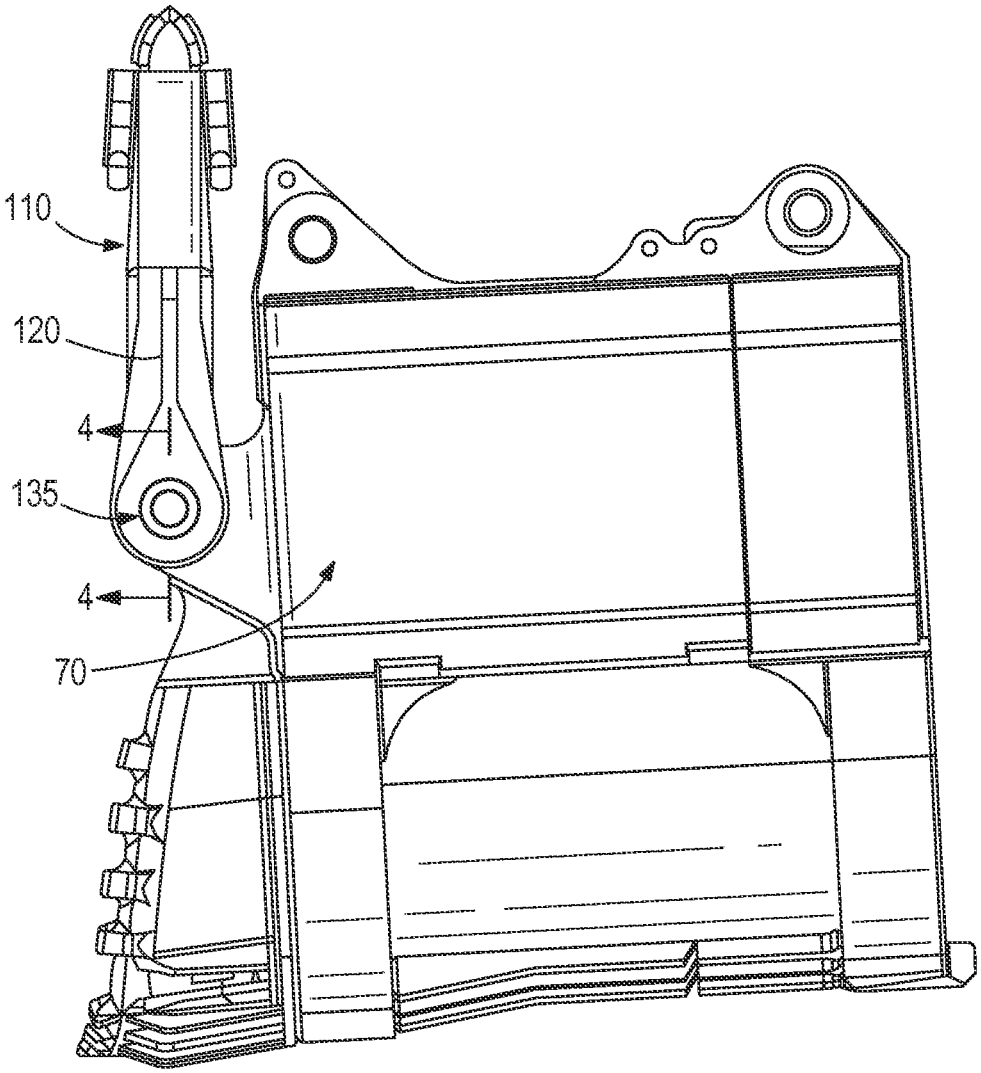
FIG. 3 is a side view of the bail and dipper.

With reference to FIG. 2, the bail 110 includes a body having two arms 120. Each of the arms 120 includes a pair of apertures 125 spaced apart from one another by a gap 130. The apertures 125 are aligned with one another to receive the bail pins 115 (only one bail pin 115 is shown in FIG. 2).

Figure 4:
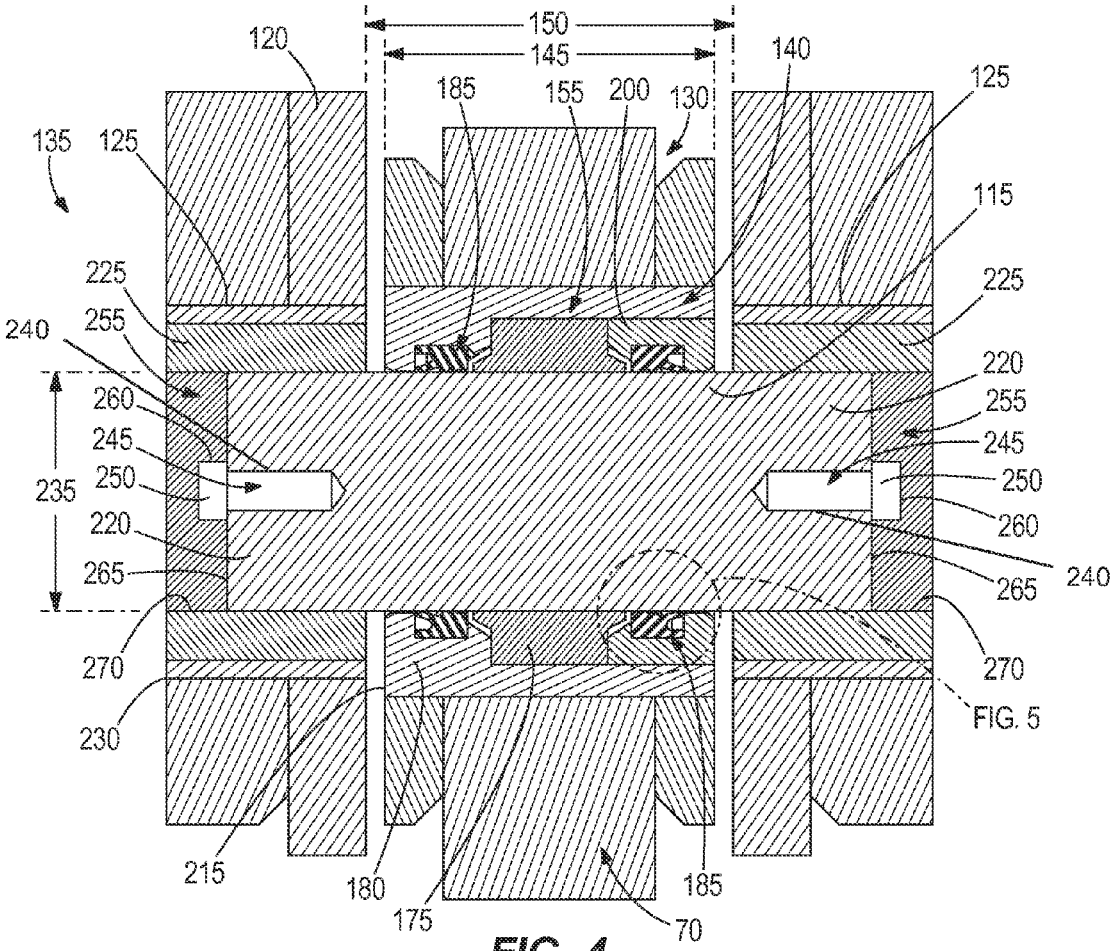
FIG. 4 is a cross-sectional view of the bushing assembly, taken along lines 4-4 in FIG. 3.

With reference to FIGS. 2-7, the machine 10 includes bushing assemblies 135 that support each of the bail pins 115. Each of the bushing assemblies 135 includes a cartridge 140. As illustrated in FIGS. 2 and 4, each cartridge 140 is positioned within the gap 130 and within a portion of the dipper 70, and has a length 145 that is smaller than a length 150 of the gap 130.

With reference to FIGS. 2, 4, 6, and 7, the cartridge 140 includes a metal body 155 defining an aperture 160 (FIGS. 6 and 7) that extends through the body 155. The aperture 160 has an inner diameter 165 that is slightly larger than an outer diameter 170 (FIG. 2) of the bail pin 115, such that the pin 115 may be extended into the aperture 160 (FIG. 4).

Figure 5:
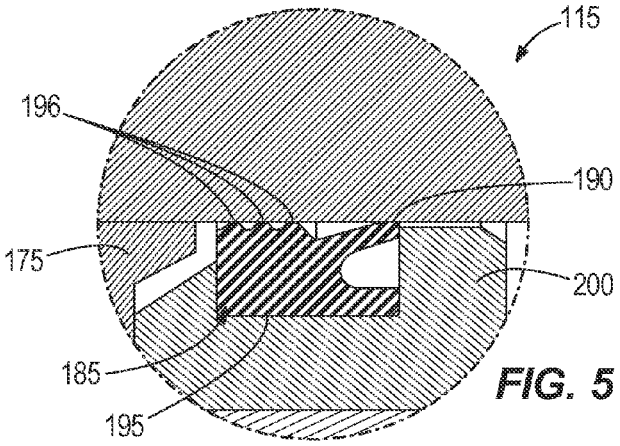
FIG. 5 is an enlarged partial view of the cross-section of FIG. 4.
Figure 7:
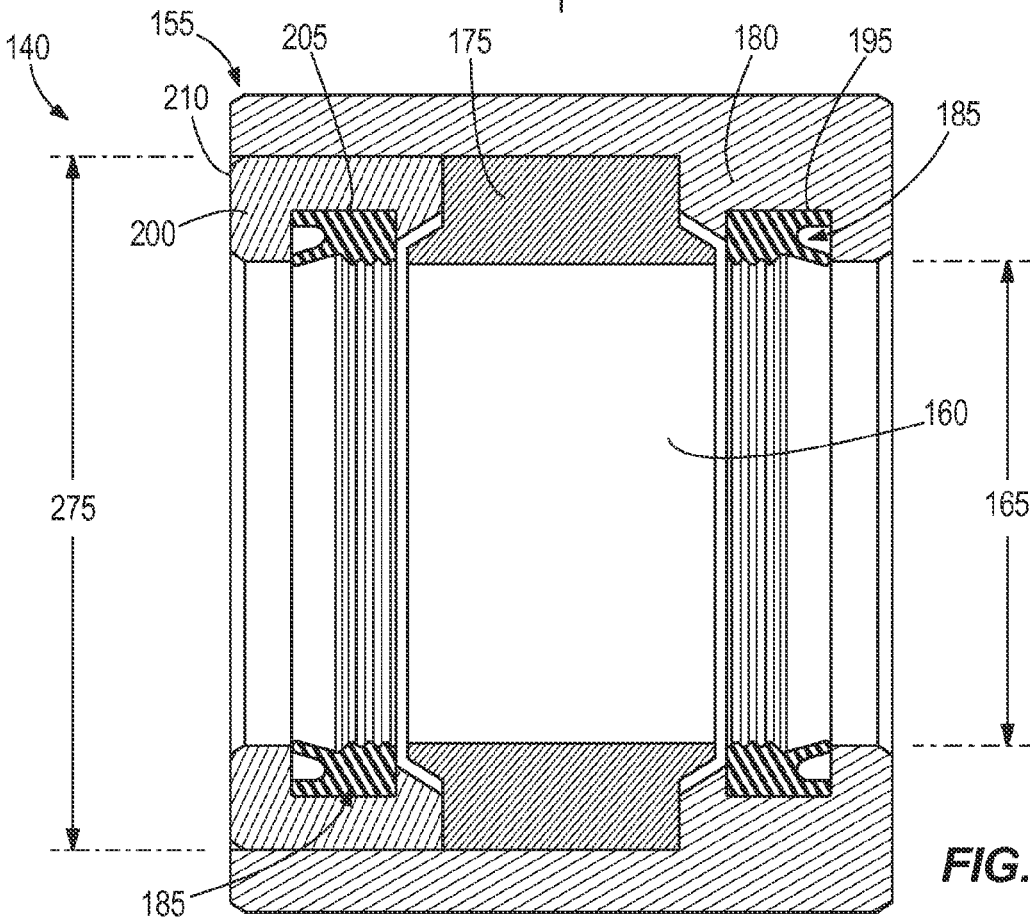
FIG. 7 is a cross-sectional view of the cartridge, taken along lines 7-7 in FIG. 6.

With reference to FIGS. 4, 5, and 7, the cartridge 140 also includes a bushing 175 disposed within the aperture 160. The illustrated bushing 175 is a spherical, self-lubricating bushing 175 that receives the pin 115, although in some constructions other bushings are used (e.g., a straight, filament wound bushing). As illustrated in FIGS. 4, 5, and 7, the body 155 includes a radially inwardly-extending portion 180 that abuts the bushing 175 and prevents the bushing 175 from moving axially in at least one direction within the aperture 160.

With reference to FIGS. 4, 5, and 7, the cartridge 140 includes internal seals 185 on either side of the bushing 175. In the illustrated constructions, two internal seals 185 are used. Each of the internal seals 185 in the illustrated construction is a heavy-duty wiper seal (e.g., made of PTFE or other suitable material). As illustrated in FIG. 5, the seals 185 each include a flap 190 that is biased into engagement with the pin 115, and is oriented (and protrudes) both axially away from the bushing 175 and radially inwardly. When the pin 115 is inserted into the cartridge 140, the flaps 190 are compressed (i.e., without folding over toward the bushing 115 or otherwise becoming damaged) in a radially outward direction, away from a normally biased state. Each of the illustrated seals 185 (and its flap 190) extends circumferentially about the pin 115 when the pin is 115 inserted into the cartridge 140, with one of the seals 185 being disposed partially within a groove 195 in the portion 180. With continued reference to FIG. 5, each seal 185 also includes one or more lips 196 (e.g., three as in the illustrated construction) that contact and seal against the pin 115 when the pin 115 is inserted into the cartridge 140.

Figure 6:
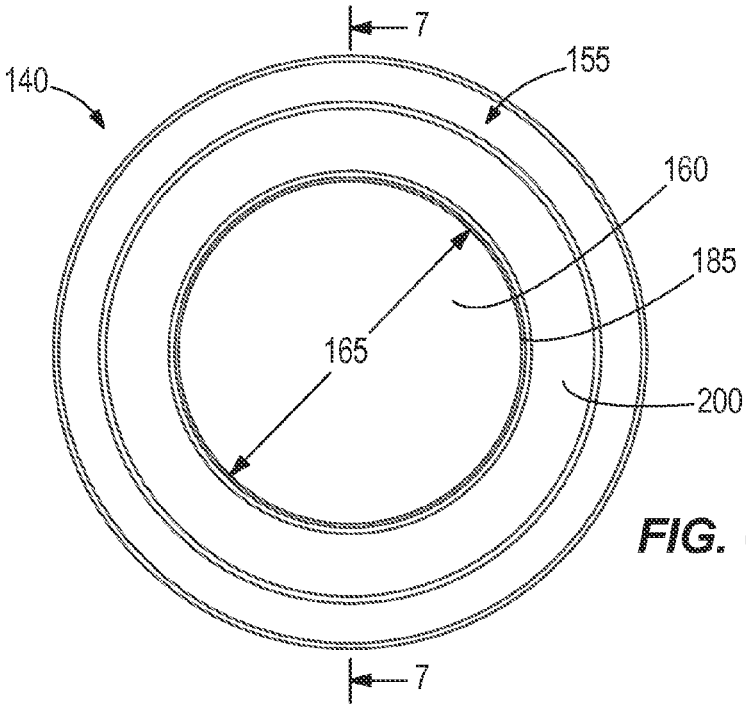
FIG. 6 is a front view of a cartridge of the bushing assembly.

With reference to FIGS. 4, 6, and 7, the cartridge 140 also includes a cartridge end cap 200. The end cap 200 is disposed at least partially within the aperture 160, and abuts the bushing 175. The end cap 200 prevents the bushing 175 from moving axially in one direction within the aperture 160. The end cap 200 and the portion 180 of the body 155 contain opposite sides of the bushing 175 and prevent the bushing 175 from moving axially within the aperture 160. As illustrated in FIG. 7, the end cap 200 also includes a groove 205, with one of the seals 185 being disposed at least partially in the groove 205.

With continued reference to FIG. 7, to assemble the cartridge 140, the bushing 175 is first inserted into the aperture 160, such that the bushing abuts the portion 180. The end cap 200 is then pressed into the aperture 160 and welded to the body 155 at a weld point or points 210. The seals 185 are then inserted into the grooves 195, 205. The seals 185 are inserted last to avoid any damage from welding and/or the pressing of the end cap 200 into the aperture 160. Other constructions include different steps and an order of assembly steps than that described above.

Once assembled, the cartridge 140 is a sealed, self-lubricating cartridge that acts as a labyrinth seal and is retrofit-able into the bail 110 without having to rework or change the bail 110. Because of the compact, tight-fitting arrangement of the components in the cartridge 140, the cartridge 140 prevents large debris from entering the area of the bushing 175. In some constructions, both the cartridge 140 and the pin 115 last as long as the dipper 70 (e.g., nine to thirteen months), without having to be replaced during the life of the dipper 70.

With reference to FIGS. 2 and 4, to assemble the bushing assembly 135, the fully assembled cartridge 140 is first inserted into the gap 130. As illustrated in FIG. 4, the cartridge 140 is welded to the dipper 70 at a weld point or points 215. The pin 115 is then passed through the cartridge 140. In some constructions, the pin 115 is coated lightly with oil to ensure that the seals 185 do not catch on the pin 115 as the pin 115 is being inserted into the cartridge. In some constructions, an assembly tool (e.g., a long, tapered section bolted to the pin 115) is used to aid in alignment and to prevent damage to the seals 185.

With the pin 115 disposed within the cartridge 140, ends 220 of the pin 115 are exposed on either side of the cartridge 140. With reference to FIGS. 1 and 4, the bushing assembly 135 further includes spacers 225 that are coupled to bail 110 and fit over the ends 220 within the apertures 125. In the illustrated construction, the spacers 225 are welded at a weld point or points 230 (as illustrated in FIG. 4) to the arm 120 of the bail 110. The spacers 225 extend circumferentially, and fit within the apertures 125. Each of the spacers 225 has an inner diameter 235 that is approximately equivalent to the outer diameter 170 of the pin 115, such that the spacers 225 fit tightly over the ends 220 of the pin 115 and prevent the pin 115 from moving radially.

With reference to FIGS. 2 and 4, the pin 115 includes apertures 240 along the ends 220. FIG. 2 illustrates three apertures 240, though other constructions include different numbers of apertures 240. The bushing assembly 135 further includes guide components 245 that are coupled to the pin 115 and are used to align and/or fix a rotation of the pin 115. In the illustrated construction the guide components 245 are fasteners that extend into one or more of the apertures 240. For example, in FIG. 2, two guide components 245 are illustrated as being aligned with two radially outer apertures 240 along one side of the pin 115, and an additional third guide component 245 is illustrated as being aligned with a central aperture 240 (in FIG. 4 the two radially outer apertures 240 and guide components 245 are not visible). In other constructions, the guide components 245 are other structures, or different numbers and arrangements of guide components 245 are used. For example, in some constructions, only two guide components 245 are used in the radially outer apertures 240, and no guide component 245 is used in the central aperture 240 (e.g., see FIG. 8). In some constructions only a single guide component 245 is used.

With continued reference to FIGS. 2 and 4, the guide components 245 are inserted into the apertures 240, either prior to inserting the pin 115 into the cartridge 140 or after inserting the pin 115 into the cartridge 140 (e.g., after the spacers 225 have also been inserted). As illustrated in FIG. 4, each of the guide components 245 in the illustrated construction includes a fastener head 250 that extends out of the end 220 of the pin 115.

Figure 8:
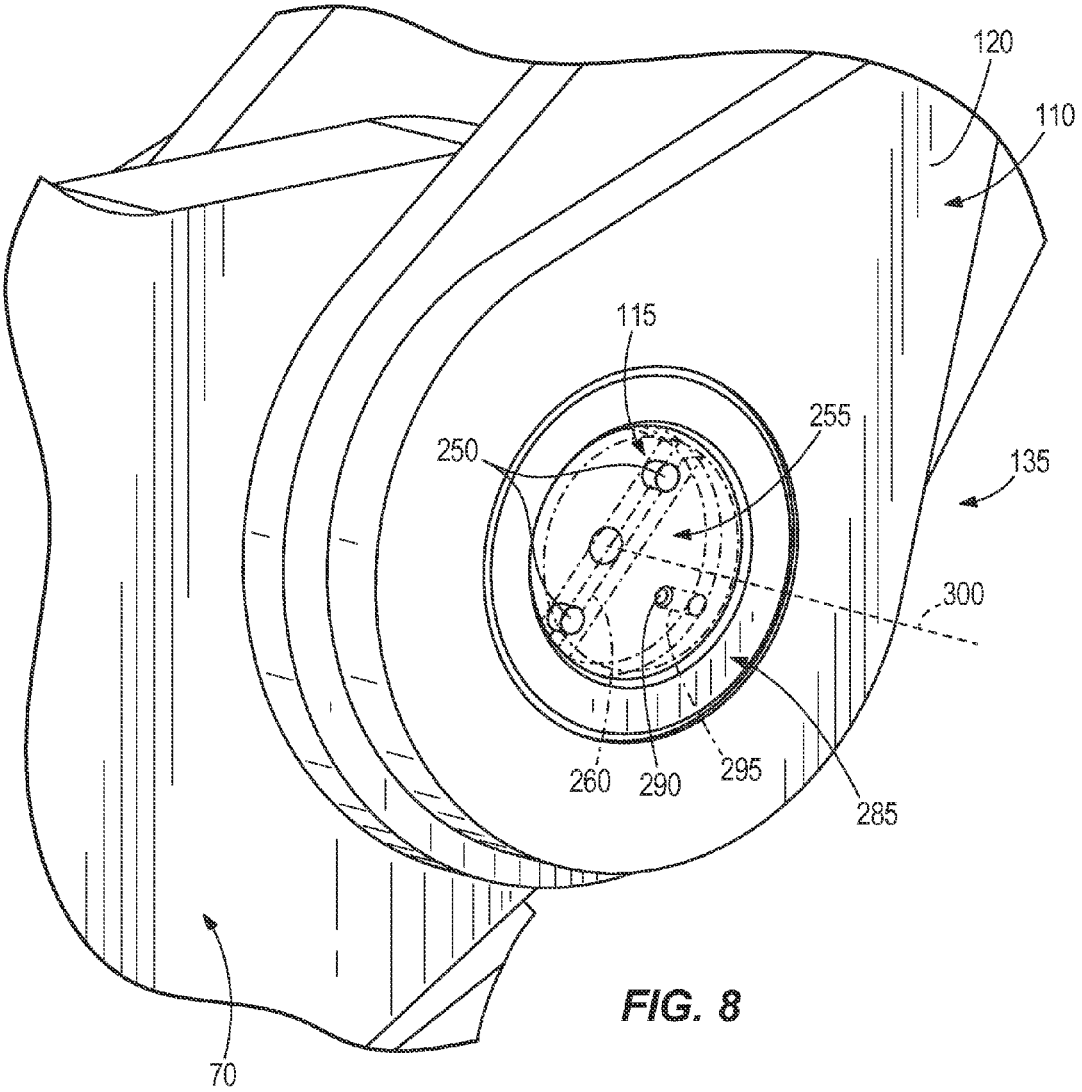
FIG. 8 is a perspective view of a detection system for use on the bushing assembly.

With reference to FIGS. 2 and 4, the bushing assembly 135 further includes end plates 255. As illustrated in FIGS. 2 and 4, each end plate 255 includes a groove 260 along an inner surface 265. In the illustrated construction the groove 260 is an elongate groove extending along a diameter of the end plate 255. Once the pin 115 has been inserted into the cartridge 140 and the guide components 245 have been inserted into the ends 220, the end plates 255 are coupled to the ends 220 by aligning the groove 260 with the fastener heads 250 protruding from the pin 115, such that the grove 260 receives each of the fastener heads 250. For example, FIG. 8 illustrates two fastener heads 250 protruding into the groove 260. The groove 260 is wide enough and deep enough to receive the fastener heads 250, and to hold the fastener heads 250. With reference to FIG. 4, after the fastener heads 250 are received in the groove 260, the end plates 255 are welded to the spacers 225 at a weld point or points 270 (shown in FIG. 4).

By welding the spacers 225 to the bail 110, welding the end plates 255 to the spacers 225, and holding the fastener heads 250 within the groove 260, the pin 115 is locked from rotating relative to the bail 110. This locking eliminates alternating loads in the pin 115, allowing for use of a smaller outer diameter 170 than is traditionally used in a bail pin, and still providing for the same load as, for example, a larger floating bail pin.

In some constructions, the cartridge 140 alone, or in conjunction with the pin 115, spacers 225, guide components 245, and/or end plates 255, is used as a kit to retrofit an existing bail 110.

In some constructions, the bushing assembly 135 is used with pins or pin locations other than the bail pin 115 and the connection between the bail 110 and the dipper 70 (e.g., with a dipper door pin or hinge).

The cartridge 140 is advantageously easy to assemble and use. For example, the seals 185 and bushing 175 are easily inserted into the cartridge, and once inserted, are positioned properly for optimal contact with the pin 115. Once assembled, the cartridge 140 is a reliable, robust structure that provides support for the pin 115, and may be used in a variety of locations and machines with predictability in supporting a pin. The cartridge 140 eliminates the time and effort required to assemble individual components together each time a pin 115 (or other pin) is to be used.

In some constructions, however, the bushing assembly 135 does not include the cartridge 140. For example, in some constructions a dipper lug (not shown) is machined to fit an exact outside diameter 275 of the bushing 175 (illustrated in FIG. 7), and the seals 185, end plates 255, and/or other components are then assembled on either side of the bushing 175.

With reference to FIG. 8, while the pin 115 is intended to be rotationally fixed relative to the bail 110, there may be some circumstances in which the fastener heads 250 or areas around the groove 260 may become worn or damaged, or other circumstances may arise in which at least some rotation of the pin 115 relative to the bail 110 takes place. To determine whether any rotation of the pin 115 relative to the bail 110 has taken place, in some constructions the bushing assembly 135 includes a detection system 285. In the illustrated construction, the detection system 285 provides a direct indication of whether the pin 115 has rotated relative to the end plate 255 (and consequently the bail 110), due to the welding of the end plates 255 to the spacers 225, and the welding of the spacers 225 to the arms 120 of the bail 110). The detection system 285 includes both a first aperture 290 disposed on one end 220 of the pin 115, as well as a second aperture 295 disposed through the end plate 255. Both the first aperture 290 and the second aperture 295 are radially offset from a central axis 300 of the pin 115. The second aperture 295 is a viewing through-hole that extends entirely through the end plate 255, such that when looking through the second aperture 295, one can view whether the first aperture 290 has moved (i.e., has rotated about the axis 300). Movement of the first aperture 290 indicates that the pin 115 has rotated relative to the end plate 255. Other constructions of the detection system 285 include different types of markings or indicators on the pin 115 other than the aperture 290.

Although the invention has been described in detail with reference to certain preferred embodiments, variations and modifications exist within the scope and spirit of one or more independent aspects of the invention as described.

The invention claimed is:

1. A cartridge for use at a pivot pin location on a mining machine, the cartridge comprising:
- a body;
- an aperture extending along an axis through the body, the aperture sized to receive a pivot pin;
- a bushing disposed within the body;
- a first internal seal disposed axially on one side of the bushing and a second internal seal disposed axially on an opposite side of the bushing; and
- an end cap disposed at least partially within the aperture that abuts the bushing and prevents the bushing from moving axially in a first direction within the aperture, wherein the end cap includes a groove, and wherein the first internal seal is disposed partially within the groove, such that the first internal seal is disposed radially between the aperture and the end cap along at least a portion of the end cap.

2. The cartridge of claim 1, wherein the body includes a radially inwardly-extending portion that abuts the bushing and prevents the bushing from moving axially in a second direction within the aperture, the second direction being opposite that of the first direction.

3. The cartridge of claim 1, wherein each of the first and second internal seals is a wiper seal that includes a flap that is compressed radially away from a normally biased state when the pin is received in the aperture.

4. The cartridge of claim 1, wherein the bushing is a self-lubricating spherical bushing.

5. A kit comprising:
- the cartridge of claim 1;
- a pivot pin configured to be inserted into the aperture of the cartridge;
- a plurality of spacers configured to be disposed on either side of the cartridge and having apertures to receive ends of the pivot pin;

a plurality of fasteners configured to be inserted into ends of the pin; and a plurality of end plates configured to be coupled to the ends of the pin, the end plates having grooves to receive heads of the fasteners.

6. The kit of claim 5, wherein the pivot pin includes a first end and a second end spaced axially from the first end, the first end including a plurality of apertures to receive the plurality of fasteners.

7. The kit of claim 6, wherein the pivot pin is a bail pin for a mining shovel.

8. The kit of claim 5, wherein each of the spacers has an inner diameter that is approximately equivalent to an outer diameter of the pin.

9. The kit of claim 5, wherein the grooves are elongate grooves extending along diameters of the end plates and being open axially inwardly toward the cartridge.

10. A cartridge for use at a pivot pin location on a mining machine, the cartridge comprising:

a body;

an aperture extending through the body sized to receive a pivot pin;

a bushing disposed within the body;

a first internal seal disposed axially on one side of the bushing and a second internal seal disposed axially on an opposite side of the bushing; and an end cap disposed at least partially within the aperture that abuts the bushing and prevents the bushing from moving axially in a first direction within the aperture;

wherein the body includes a radially inwardly-extending portion that abuts the bushing and prevents the bushing from moving axially in a second direction within the aperture, the second direction being opposite that of the first direction.

11. The cartridge of claim 10, wherein each of the first and second internal seals is a wiper seal that includes a flap that is compressed radially away from a normally biased state when the pin is received in the aperture.

12. The cartridge of claim 10, wherein the end cap includes a groove, and wherein the first internal seal is disposed at least partially within the groove.

13. The cartridge of claim 10, wherein the bushing is a self-lubricating spherical bushing.

14. A kit comprising:

the cartridge of claim 10;

a pivot pin configured to be inserted into the aperture of the cartridge;

a plurality of spacers configured to be disposed on either side of the cartridge and having apertures to receive ends of the pivot pin;

a plurality of fasteners configured to be inserted into ends of the pin; and a plurality of end plates configured to be coupled to the ends of the pin, the end plates having grooves to receive heads of the fasteners.

15. The kit of claim 14, wherein the pivot pin includes a first end and a second end spaced axially from the first end, the first end including a plurality of apertures to receive the plurality of fasteners.

16. The kit of claim 15, wherein the pivot pin is a bail pin for a mining shovel.

17. The kit of claim 14, wherein each of the spacers has an inner diameter that is approximately equivalent to an outer diameter of the pin.

18. The kit of claim 14, wherein the grooves are elongate grooves extending along diameters of the end plates and being open axially inwardly toward the cartridge.

* * * * *